US006188774B1

(12) United States Patent
Sabato et al.

(10) Patent No.: US 6,188,774 B1
(45) Date of Patent: Feb. 13, 2001

(54) LOUDSPEAKER

(75) Inventors: Takashi Sabato; Kazuhiro Oshika, both of Matsusaka (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/341,520

(22) PCT Filed: Nov. 13, 1998

(86) PCT No.: PCT/JP98/05113

§ 371 Date: Jul. 13, 1999

§ 102(e) Date: Jul. 13, 1999

(87) PCT Pub. No.: WO99/26452

PCT Pub. Date: May 27, 1999

(30) Foreign Application Priority Data

Nov. 14, 1997 (JP) ..... 9-313009

(51) Int. Cl.[7] ..... H04R 25/00

(52) U.S. Cl. ..... 381/424; 381/423; 381/405; 181/163

(58) Field of Search ..... 381/423, 424, 381/431, 432, 404, 405, 186, FOR 162, FOR 163, FOR 164; 181/157, 163, 164

(56) References Cited

U.S. PATENT DOCUMENTS 2,231,479 * 2/1941 Perry ..... 381/405
4,320,264 * 3/1982 Visan et al. ..... 381/432
5,933,512 * 8/1999 Tamura ..... 381/424

FOREIGN PATENT DOCUMENTS 6-111399 9/1981 (JP) .
56-163394 12/1981 (JP) .
1-78494 5/1989 (JP) .
4-192800 7/1992 (JP) .

* cited by examiner

*Primary Examiner*—Huyen Le
(74) *Attorney, Agent, or Firm*—McDermott, Will & Emery

(57) ABSTRACT

A flat loudspeaker of superior quality for use in audio appliances, in which loudspeaker the generation of abnormal sounds is eliminated by placing a voice coil with a high accuracy in the magnetic gap. A diaphragm is split into a main diaphragm (11) and a sub-diaphragm (12); a voice coil (8) is connected to the inner circumference of the main diaphragm (11) whose inner diameter is substantially identical with the diameter of the magnetic gap (5). In the loudspeaker, the voice coil (8) is placed in a right positioning without inclination and eccentricity relative to the magnetic gap (5), abnormal sounds are eliminated, and a thinner configuration and a lower rejection rate are made compatible.

6 Claims, 6 Drawing Sheets

LOUDSPEAKER

TECHNICAL FIELD

The present invention relates to a loudspeaker used in various audio/visual appliances.

BACKGROUND ART

In order to make a space required for installing a loudspeaker system smaller, there has been a strong voice in the market requesting a flat loudspeaker. A number of new creations have so far been announced for meeting the request.

A conventional flat loudspeaker is described below referring to FIG. 9, which shows a cross sectional side view.

As shown in FIG. 9, a damper 9, which is provided at a place inner from a magnetic gap 5, is not coupled direct with a voice coil 8, but the outer circumferential edge is connected to a plate 4 while the central portion is connected to a protrusion of a diaphragm 15 coming downward from the central part of the diaphragm. Thus, a cavity made available within the inner circumference of a magnet 2 is utilized as a space 6 for damper amplification. A loudspeaker can be fabricated in a thinner configuration adopting the above-described structure.

A magnetic circuit 1 is consisted of a magnet 2, a yoke 3 and a plate 4. Between the yoke 3 and the plate 4 is a magnetic gap 5. A frame 7 is fixed to the yoke 3. Voice coil 8 is connected to the diaphragm 15 at one end, while the other end is adapted to the magnetic gap 5. An edge 10 is connected at the inner circumference with the outer circumferential portion of the diaphragm 15, and the outer circumference of edge is connected with the inner rim section of the frame 7.

In assembling the above described conventional loudspeaker, the voice coil 8 has to be inserted to a right position in the magnetic gap 5 in a state where the voice coil 8 was already integrated with the diaphragm 15. Therefore, there is a substantially high possibility that the voice coil 8 is disposed oblique and/or eccentric to the magnetic gap 5. This leads to a possibility for the coil of the voice coil 8 coming in touch with the plate 4 or the yoke 3, which generates abnormal sounds.

The present invention addresses the above problem, and aims to present a loudspeaker improving the trade-off between the flat contour and the low rejection rate.

DISCLOSURE OF THE INVENTION

In an invented loudspeaker, an edge is connected at the outer circumferential portion with rim section of a frame fixed to a magnetic circuit, a main diaphragm is connected at the outer circumferential portion with the inner circumferential portion of the edge, a voice coil to be placed in a magnetic gap of the magnetic circuit is connected with the inner circumferential portion of the main diaphragm, a damper disposed at a place inner than the magnetic gap is fixed at the outer circumferential part with a plate of the magnetic circuit, the damper is connected at the central part with the central portion of a sub-diaphragm, the outer circumferential portion of said sub-diaphragm is connected with the upper surface of the main diaphragm at a location outer than a point where the main diaphragm is connected to the voice coil. With the above described structure, the main diaphragm is placed and connected between the frame and the voice coil while the voice coil is being held at a right positioning in the magnetic gap with the aid of a spacer or the like positioning jig. Therefore, the problem that abnormal sounds are generated by the coil of voice coil coming in contact with the plate or the yoke can be avoided.

BEST MODE FOR CARRYING OUT THE INVENTION

Embodiment 1

Figure 1A:
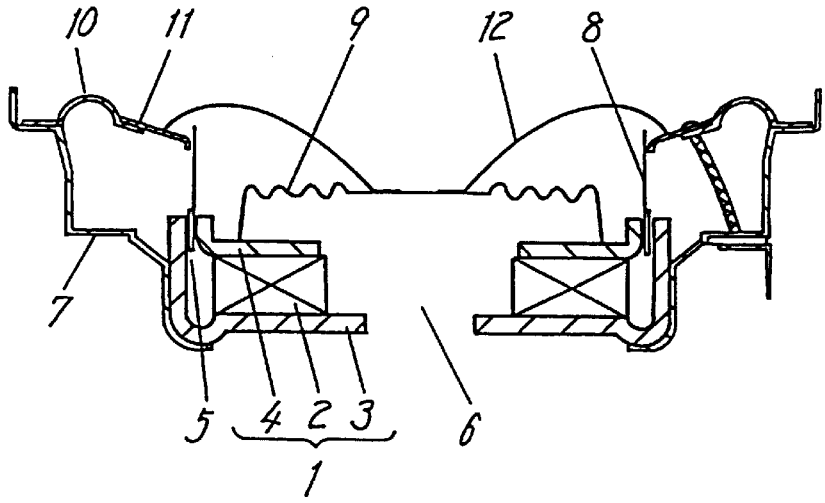
FIG. 1(*a*) is a cross sectional side view of a loudspeaker in accordance with a first exemplary embodiment of the present invention, FIG. 1(*b*) is a cross sectional side view used to describe a half-finished state of the loudspeaker.
Figure 1B:
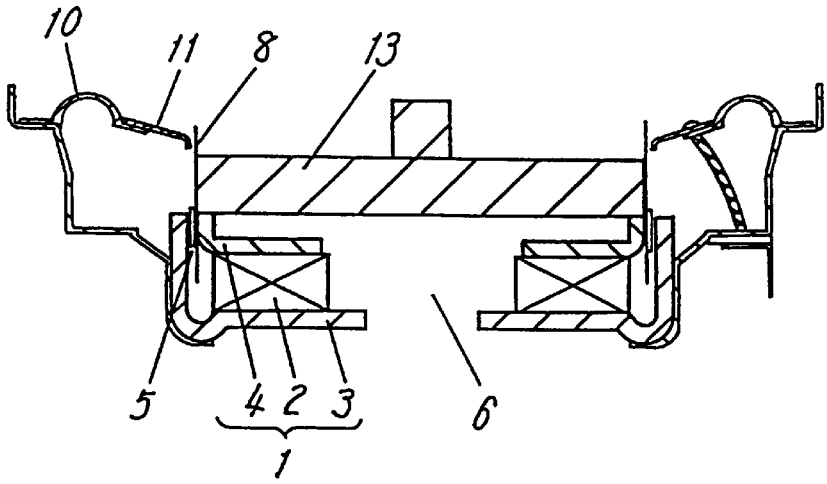

A loudspeaker in accordance with a first exemplary embodiment of the present invention is described below with reference to the drawings FIG. 1(*a*) and FIG. 1(*b*).

An inner magnet type magnetic circuit 1 comprises a magnet 2, a yoke 3 and a plate 4; which magnetic circuit constitutes a magnetic gap 5 and houses within the inside a space 6 for the amplitude of a damper 9. A voice coil 8 is placed inside the magnetic gap 5 and connected with the inner circumferential portion of a main diaphragm 11 whose outer circumference is connected with a frame 7. The inner diameter of main diaphragm 11 is substantially identical to the diameter of magnetic gap 5. A sub-diaphragm 12 is provided bridging the central part of damper 9 and the upper surface of main diaphragm 11.

The assembly of above loudspeaker is described in the following. The voice coil 8 is first fitted on a spacer 13 to a right position in terms of vertical direction, and then the spacer 13 carrying the voice coil 8 is mounted on the plate 4.

An edge 10 whose inner circumference is connected in advance with the outer circumferential portion of main diaphragm 11 is connected to the frame 7, and the inner circumference of main diaphragm 11 is connected with the voice coil 8. When, the voice coil 8 is placed in the magnetic gap 5 with a certain predetermined air gap secured by means of spacer 13. The above state is shown in FIG. 1(*b*). After the spacer 13 is withdrawn, the outer circumference of damper 9 is connected to the inner circumferential part of plate 4, the central part of damper 9 is connected with the central portion of sub-diaphragm 12, and the outer circumferential portion of sub-diaphragm 12 is connected with the upper surface of main diaphragm 11.

Figure 5:
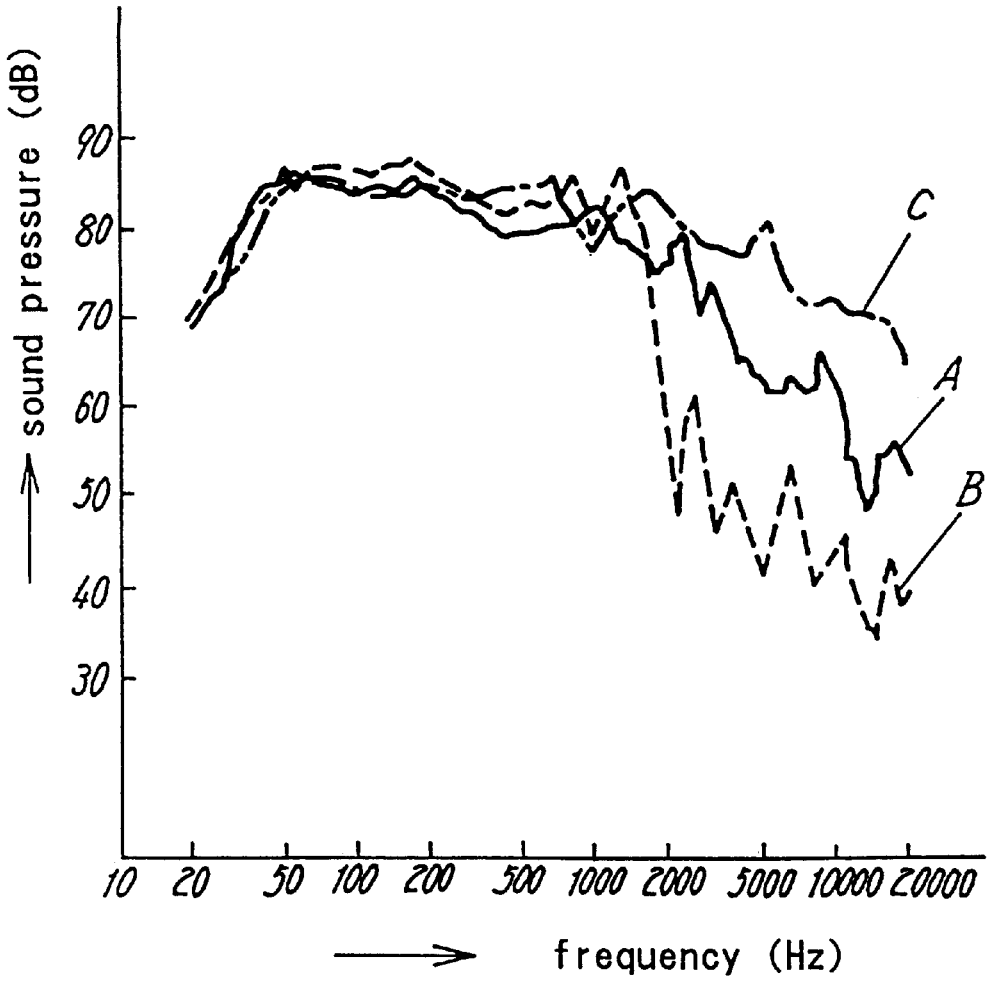
FIG. 5 is a chart showing the frequency characteristics of loudspeakers fabricated in accordance with the first, third and fourth embodiments.

As described in the above, diaphragm of the invented loudspeaker is split into main diaphragm 11 and sub-diaphragm 12. Therefore, the invented loudspeaker can be assembled using a spacer 13, in the same manner as the assembly operation of ordinary (non flat) loudspeakers. Namely, a voice coil 8 is placed in a right positioning without inclination and/or eccentricity relative to magnetic gap 5 also in a flat loudspeaker, in which a damper 9 is disposed in a place inner than magnetic gap 5 and a cavity made available within inside of an inner magnetic type magnetic circuit 1 is utilized as a space 6 for the amplitude. Therefore, the invented loudspeaker eliminates the abnormal sounds. The two contradictory requirements for a loudspeaker, namely a thinner configuration and the lower rejection rate are thus made compatible. The frequency characteristics of a loudspeaker of the present exemplary embodiment is shown in FIG. 5 with line A.

Embodiment 2

Figure 2:
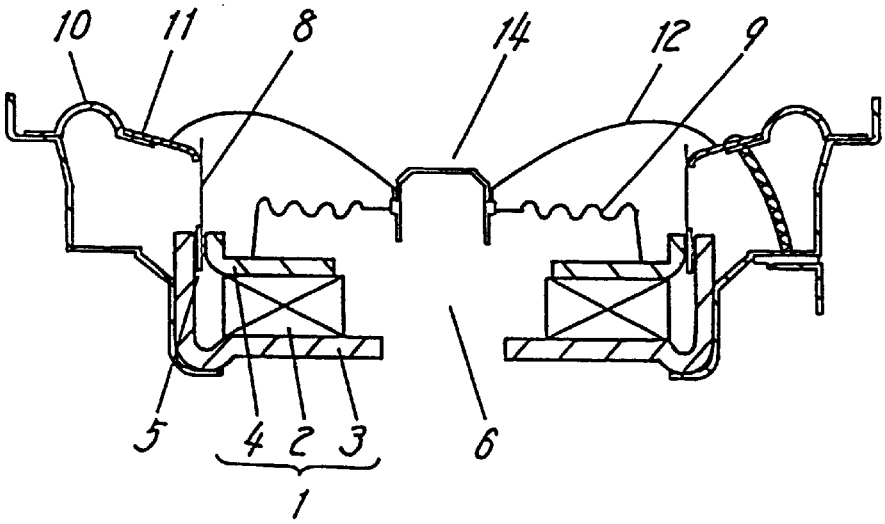
FIG. 2 is a cross sectional side view of a loudspeaker in accordance with a second exemplary embodiment of the present invention.

FIG. 2 shows a cross sectional side view of a loudspeaker in accordance with a second exemplary embodiment of the present invention. In the drawing, those parts identical to those of the first embodiment are represented by using the same marks and descriptions of which are not repeated here. The point of difference from the first embodiment is that a loudspeaker of the present embodiment is provided with a center cap 14 functioning as means for preventing the eccentricity. The damper 9 and the sub-diaphragm 12 are connected at their inner circumference to the center cap 14.

The center cap 14 connected to the inner circumference of damper 9 and the inner circumference of sub-diaphragm 12 contributes to reinforce the adhesion strength of sub-diaphragm 12 and damper 9. The center cap 14 also contributes to reduce the eccentricities among sub-diaphragm 12 and main diaphragm 11, and damper 9 and sub-diaphragm 12.

Embodiment 3

Figure 3:
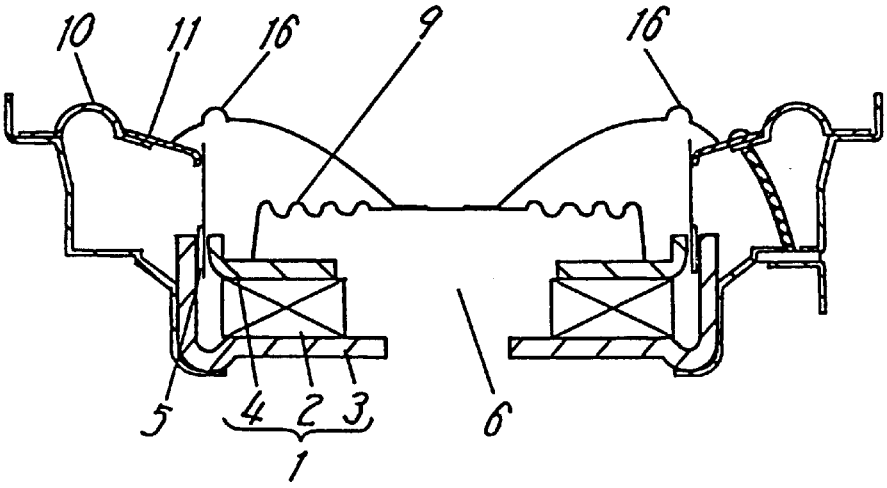
FIG. 3 is a cross sectional side view of a loudspeaker in accordance with a third exemplary embodiment of the present invention.

FIG. 3 is a cross sectional side view of a loudspeaker in accordance with a third exemplary embodiment of the present invention. The point of difference from the first embodiment is that due to a compliance stemming from an edge sector 16 provided in an outer circumferential area of sub-diaphragm 12 the high-pitched sound radiated from sub-diaphragm 12 is attenuated, and the high area frequency characteristics are also attenuated steeply.

The frequency characteristics of a loudspeaker of the present exemplary embodiment is shown in FIG. 5 with line B.

Embodiment 4

Figure 4:
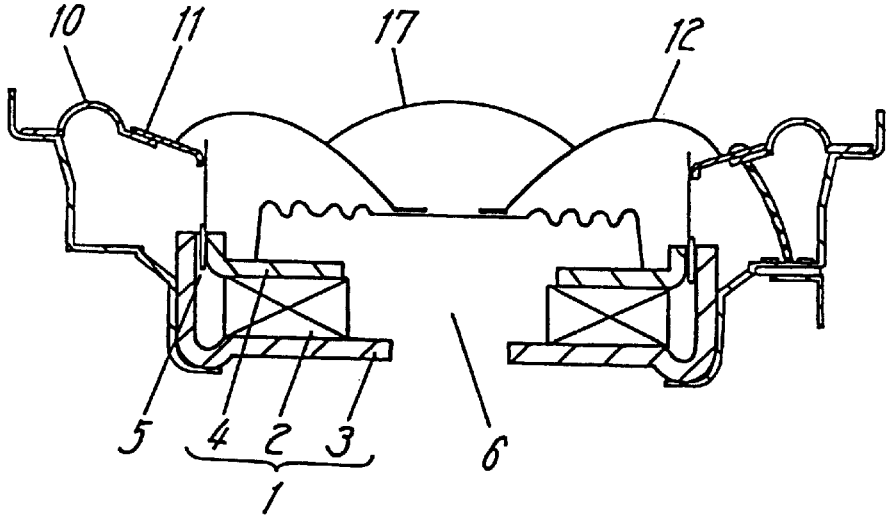
FIG. 4 is a cross sectional side view of a loudspeaker in accordance with a fourth exemplary embodiment of the present invention.

FIG. 4 is a cross sectional side view of a loudspeaker in accordance with a fourth exemplary embodiment of the present invention. The point of difference from the first embodiment is that a dust cap 17 is provided connected on the upper surface of sub-diaphragm 12. This contributes to make the frequency characteristics flatter and improves the directivity, the esthetic elements of a loudspeaker are also improved. The dust cap 17 may be connected on the main diaphragm 11, instead of connecting to the sub-diaphragm 12.

The frequency characteristics of a loudspeaker of the present exemplary embodiment is shown in FIG. 5 with line C.

Embodiment 5

Figure 6:
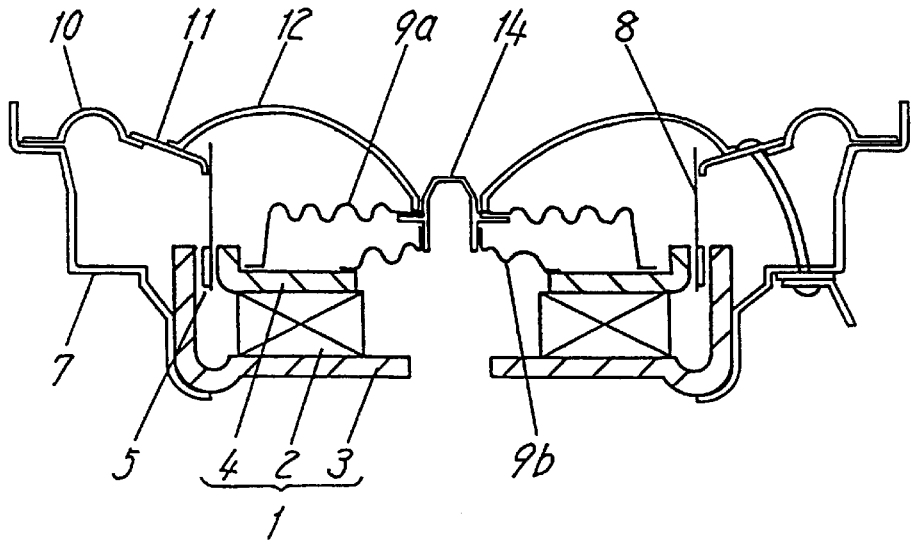
FIG. 6 is a cross sectional side view of a loudspeaker in accordance with a fifth exemplary embodiment of the present invention.

FIG. 6 is a cross sectional side view of a loudspeaker in accordance with a fifth exemplary embodiment of the present invention. The point of difference from the second embodiment is that a main damper 9*a* is provided in a place which is inner than the magnetic gap 5 at a level higher than the coil of voice coil 8, and a center cap 14 is connected to the central part of the main damper 9*a*. A sub-damper 9*b* is connected with the center cap 14 at a level lower than the main damper 9*a*, the sub-diaphragm 12 is bridging the center cap 14 and the main diaphragm 11.

With the above described structure, the main damper 9*a* is formed in a place in height between the edge of main diaphragm 11 connected to the frame 7 and located outer than the voice coil 8 and the coil of voice coil 8 suspended in the magnetic gap 5 of magnetic circuit 1. The sub-damper 9*b* is formed in a place under and inward relative to the main damper 9*a*. The main damper 9*a* and the sub-damper 9*b* are connected with the magnetic circuit 1. Therefore, the main damper 9*a* takes part of the control in axial direction while the sub-damper 9*b* takes part of the control in radial direction. This improves the linearlity at a great amplitude, leading to a much gain in the quantity of amplitude.

The above described structure also enables to reduce the overall height of voice coil 8 by forming the main damper 9*a* and the sub-damper 9*b* within a space inner than the magnetic gap 5 of magnetic circuit. The height reduction of voice coil was difficult in a large input type loudspeaker of this category. As a result, the overall height of a loudspeaker can be reduced. Thus the contour of a loudspeaker can be made thinner even in a limited space available and a limitation in the diameter. In addition to a great amplitude available and an improved durability against a high input, an invented loudspeaker provides a sound reproduction of low distortion. The present invention offers a versatile loudspeaker of superior acoustic performance whose contour is thin and compact contour capable of meeting various practical requirements.

Figure 7:
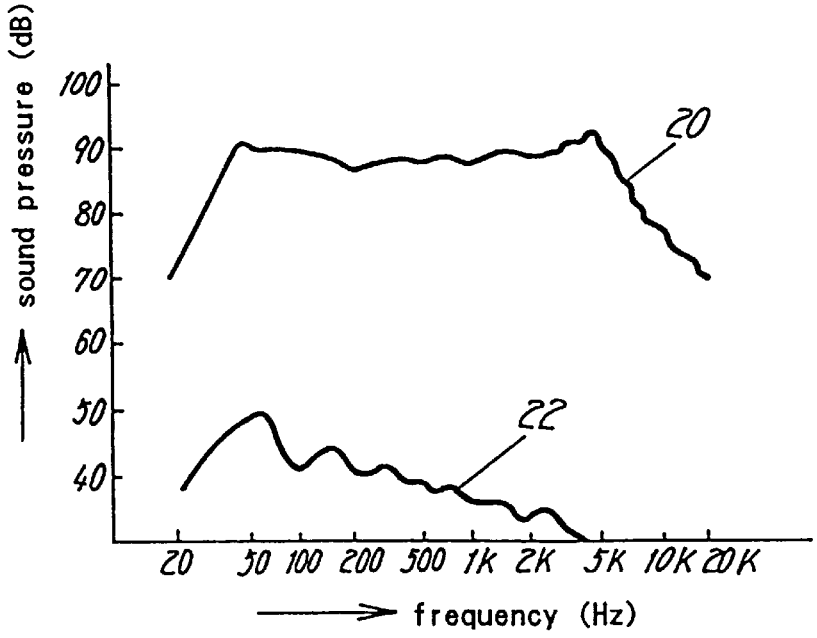
FIG. 7 is a chart showing the frequency characteristics of the loudspeaker of sixth embodiment.

FIG. 7 shows the sound pressure frequency characteristics and second harmonic distortion characteristics of a loudspeaker of the present embodiment. The loudspeaker of the present embodiment exhibited a sound pressure frequency characteristics curve 20 that is more flat and high in level as compared with those of other loudspeakers of the foregoing embodiments. The loudspeaker of the present embodiment reproduced a rich low sound in the low area of sound pressure frequency characteristics, also in the high area it reproduced a remarkably rich high sound. Furthermore, with respect to the second harmonic distortion, the loudspeaker realized a low distortion accomplishing a high linearlity, as indicated by the curve 22.

Embodiment 6

Figure 8:
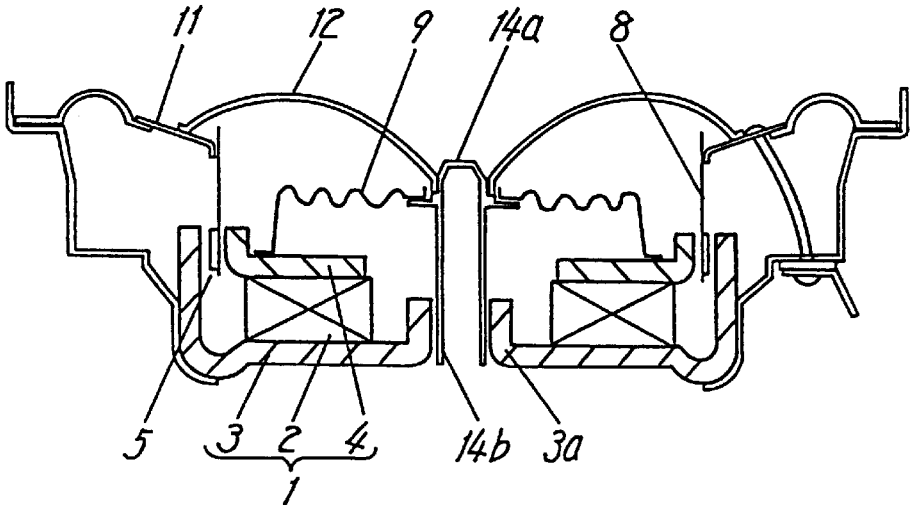
FIG. 8 is a cross sectional side view of a loudspeaker in accordance with a sixth exemplary embodiment of the present invention.
Figure 9:
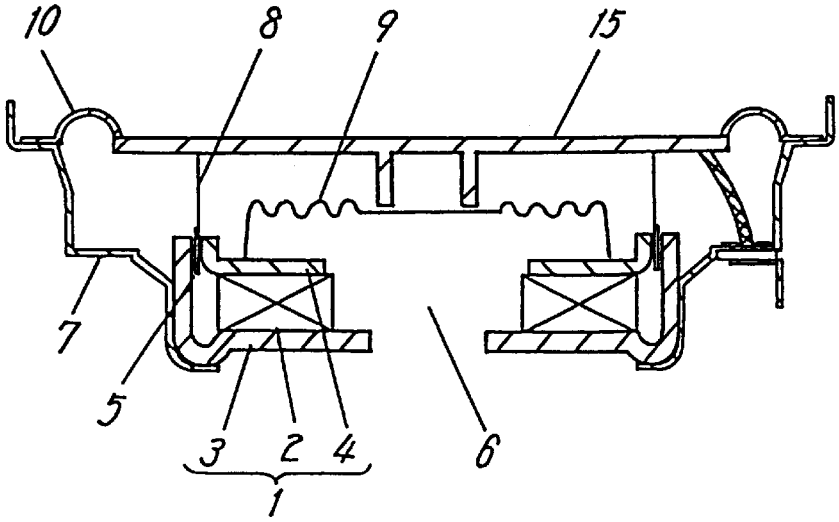
FIG. 9 is a cross sectional side view of a conventional flat loudspeaker.

FIG. 8 shows a cross sectional side view of a loudspeaker in accordance with a sixth embodiment of the present invention. The point of difference from the embodiment 2 is that a lower cylindrical portion 14*b* is provided as the downward extension of center cap 14*a*, and a guide portion 3*a* is provided at the center of yoke 3.

In the present embodiment, the lower cylindrical portion 14*b* of center cap 14*a* connected with the central parts of damper 9 and sub-diaphragm 12 is extended to the center bottom part of the magnetic circuit 1, and the guide portion 3*a* is bent upward so as to guide the lower cylindrical portion 14*b* to a right positioning. This controls the amplitude in both axial and radial directions to a further improved linearlity. Therefore the main diaphragm 11 is allowed to move, without having been provided with a sub-damper 9*b* employed in embodiment 5, for a great amplitude until the damper 9 is pulled to an extreme length.

Although a cone-shaped diaphragm has been exemplified in each of the foregoing embodiments, the same effects may of course be obtained with a diaphragm of other shapes, such as a flat shape, a domed shape, or the like.

INDUSTRIAL APPLICABILITY

In an invented loudspeaker, an edge is connected at the outer circumferential portion with rim section of a frame fixed to a magnetic circuit, a main diaphragm is connected at the outer circumferential portion with the inner circumferential portion of the edge, a voice coil to be placed in a magnetic gap of the magnetic circuit is connected with the inner circumferential portion of the main diaphragm, a damper disposed at a place inner than the magnetic gap is connected at the outer circumferential part to a plate of the magnetic circuit, the damper is connected at the central part with the central portion of a sub-diaphragm, the outer circumferential portion of said sub-diaphragm is connected with the upper surface of the main diaphragm at a place outer than a point where the main diaphragm is connected with the voice coil. With the above described structure, the main diaphragm is placed and connected between the frame and the voice coil while the voice coil is being held at a right position in the magnetic gap by the aid of a spacer or the like positioning jig. Therefore, a problem that abnormal sounds are generated by the coil of voice coil coming in touch with the plate or the yoke may be eliminated. Furthermore, because a diaphragm has been split into two, viz. the main and the sub diaphragms, the freedom of combining different shapes and materials for a diaphragm is expanded. This enables a loudspeaker to control the characteristics for a wide frequency range.

Besides the above described, following advantages are brought about with the invented loudspeakers:

(1) In a loudspeaker in which the inner circumferential part of damper and the inner circumferential portion of sub-diaphragm has been coupled via the center cap, the adhesion strength of sub-diaphragm and damper is enhanced, and the eccentricity of damper and sub-diaphragm may be reduced.

(2) In a loudspeaker in which the outer part of sub-diaphragm has been provided with an edge sector, the high range frequency characteristics is steeply attenuated.

(3) In a loudspeaker in which a dust cap has been provided on the upper surface of main diaphragm or sub-diaphragm, the frequency characteristics are made flatter, the directivity improved, and the esthetic points also improved.

(4) In a loudspeaker of item (2) above in which other damper is additionally provided between the center cap disposed in the center of the damper and the plate, the great amplitude and the high durability against a high input are realized, and a low distortion is also realized.

(5) In a loudspeaker of item (2) above in which the center cap is extended downward to be guided by a part of the magnetic circuit, the linearlity in the driving of the main and sub-diaphragms is improved as a result of the guidance provided to the center cap. A great amplitude may be realized.

What is claimed is:

1. A loudspeaker, wherein an edge is connected at the outer circumferential portion with rim section of a frame fixed to a magnetic circuit; a main diaphragm is connected at the outer circumferential portion with the inner circumferential portion of the edge; a voice coil to be placed in a magnetic gap of the magnetic circuit is connected with the inner circumferential portion of the main diaphragm; a damper disposed at a place inner than the magnetic gap is fixed at the outer circumferential part with a plate of the magnetic circuit; the damper is connected at the central part with the central portion of a sub-diaphragm; and the outer circumferential portion of said sub-diaphragm is connected to the upper surface of the main diaphragm at a place outer than a point where the main diaphragm is connected with the voice coil.

2. The loudspeaker of claim 1, wherein the central part of damper is coupled with the central portion of sub-diaphragm via a center cap.

3. The loudspeaker of claim 2, wherein other damper is additionally provided between the center cap disposed in the center of damper and the plate.

4. The loudspeaker of claim 2, wherein the center cap is extended downward to be guided by a part of the magnetic circuit.

5. The loudspeaker of claim 1, wherein an edge sector is provided in the outer circumferential portion of sub-diaphragm.

6. The loudspeaker of claim 1, wherein a dust cap is provided on the upper surface of the main diaphragm or sub-diaphragm.

* * * * *